US011320767B2

(12) United States Patent
Shimokawa et al.

(10) Patent No.: US 11,320,767 B2
(45) Date of Patent: May 3, 2022

(54) HEATING DEVICE, FIXING DEVICE, AND IMAGE FORMING APPARATUS

(71) Applicant: Ricoh Company, Ltd., Tokyo (JP)

(72) Inventors: Toshihiko Shimokawa, Kanagawa (JP); Ippei Fujimoto, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 17/156,691

(22) Filed: Jan. 25, 2021

(65) Prior Publication Data

US 2021/0294247 A1 Sep. 23, 2021

(30) Foreign Application Priority Data

Mar. 19, 2020 (JP) ..... JP2020-048746

(51) Int. Cl.
*G03G 15/20* (2006.01)

(52) U.S. Cl.
CPC ..... *G03G 15/2017* (2013.01); *G03G 15/2053* (2013.01); *G03G 15/2064* (2013.01)

(58) Field of Classification Search
CPC ..... G03G 15/2017; G03G 15/2039; G03G 15/2042; G03G 15/2046; G03G 15/2053; G03G 2215/2003
See application file for complete search history.

(56) References Cited

U.S. PATENT DOCUMENTS

2015/0125193 A1 5/2015 Ishii et al.
2017/0176906 A1 6/2017 Sawada et al.
2017/0176907 A1 6/2017 Sawada et al.
2017/0255149 A1 9/2017 Takagi et al.
2018/0173138 A1* 6/2018 Seki ..... G03G 15/2017
2018/0335733 A1 11/2018 Matsuda et al.
2020/0033777 A1 1/2020 Fujimoto et al.
2020/0285182 A1 9/2020 Takahashi et al.

FOREIGN PATENT DOCUMENTS

JP 2015-111243 6/2015
JP 2015-145950 8/2015
JP 2015-152752 8/2015
JP 2015-219510 12/2015
JP 2016-099590 5/2016
JP 2018-169467 11/2018

* cited by examiner

*Primary Examiner* — Thomas S Giampaolo, II
(74) *Attorney, Agent, or Firm* — Xsensus LLP

(57) ABSTRACT

A heating device includes a tubular rotator that rotates and a heat source that heats the tubular rotator. A thermal conductor includes a first face that contacts the tubular rotator and a second face that is opposite the first face. A first thickness portion is disposed in a first span of the thermal conductor in a longitudinal direction of the thermal conductor. The first thickness portion has a first thickness. A second thickness portion is disposed in at least a part of a second span of the thermal conductor in the longitudinal direction of the thermal conductor. The second span is different from the first span. The second thickness portion has a second thickness that is greater than the first thickness of the first thickness portion. The second thickness portion includes a folded portion that is disposed on the second face.

13 Claims, 7 Drawing Sheets

HEATING DEVICE, FIXING DEVICE, AND IMAGE FORMING APPARATUS

CROSS-REFERENCE TO RELATED APPLICATION

This patent application is based on and claims priority pursuant to 35 U.S.C. § 119(a) to Japanese Patent Application No. 2020-048746, filed on Mar. 19, 2020, in the Japan Patent Office, the entire disclosure of which is hereby incorporated by reference herein.

BACKGROUND

Technical Field

Exemplary aspects of the present disclosure relate to a heating device, a fixing device, and an image forming apparatus, and more particularly, to a heating device incorporating a tubular rotator heated by a heat source, a fixing device incorporating the heating device, and an image forming apparatus such as a copier, a printer, a facsimile machine, a printing machine, an inkjet recording apparatus, and a multifunction peripheral.

Discussion of the Background Art

Related-art image forming apparatuses, such as copiers, facsimile machines, printers, and multifunction peripherals (MFP) having two or more of copying, printing, scanning, facsimile, plotter, and other functions, typically form an image on a recording medium according to image data by electrophotography.

Such image forming apparatuses may include a fixing device employing a fixing belt system that warms up the fixing device quickly. In the fixing belt system, a pressure roller is pressed against a nip former via a thin, fixing belt having a film shape to form a fixing nip between the fixing belt and the pressure roller.

An inner circumferential surface of the fixing belt slides over a surface of the nip former via a lubricant. The nip former includes a base and a thermal conduction aid. The base is supported by a stay. The thermal conduction aid is mounted on the base and is in contact with the inner circumferential surface of the fixing belt.

The thermal conduction aid is made of a material having an increased thermal conductivity, such as copper and aluminum. The thermal conduction aid decreases unevenness in the temperature of the fixing belt in a longitudinal direction thereof. When a plurality of small recording media is conveyed over the fixing belt, a non-conveyance span on the fixing belt, where the small recording media are not conveyed, may suffer from temperature increase. The thermal conduction aid facilitates conduction of heat in the fixing belt, suppressing temperature increase of the non-conveyance span on the fixing belt and improving productivity when the small recording media are conveyed over the fixing belt continuously.

SUMMARY

This specification describes below an improved heating device. In one embodiment, the heating device includes a tubular rotator that rotates and a heat source that heats the tubular rotator. A thermal conductor includes a first face that contacts the tubular rotator and a second face that is opposite the first face. A first thickness portion is disposed in a first span of the thermal conductor in a longitudinal direction of the thermal conductor. The first thickness portion has a first thickness. A second thickness portion is disposed in at least a part of a second span of the thermal conductor in the longitudinal direction of the thermal conductor. The second span is different from the first span. The second thickness portion has a second thickness that is greater than the first thickness of the first thickness portion. The second thickness portion includes a folded portion that is disposed on the second face.

This specification further describes an improved fixing device. In one embodiment, the fixing device includes a tubular rotator that rotates and a heat source that heats the tubular rotator. A nip former is disposed opposite an inner circumferential surface of the tubular rotator. A support supports the nip former. A pressure rotator presses against the nip former via the tubular rotator to form a nip between the tubular rotator and the pressure rotator, through which a recording medium is conveyed. The nip former includes a base and a thermal conductor that is mounted on the base and has a thermal conductivity that is greater than a thermal conductivity of the support. The thermal conductor includes a first face that contacts the tubular rotator and a second face that is opposite the first face. A first thickness portion is disposed in a first span of the thermal conductor in a longitudinal direction of the thermal conductor. The first thickness portion has a first thickness. A second thickness portion is disposed in at least a part of a second span of the thermal conductor in the longitudinal direction of the thermal conductor. The second span is different from the first span. The second thickness portion has a second thickness that is greater than the first thickness of the first thickness portion. The second thickness portion includes a folded portion that is disposed on the second face.

This specification further describes an improved image forming apparatus. In one embodiment, the image forming apparatus includes an image forming device that forms an image and the fixing device described above that fixes the image on a recording medium.

BRIEF DESCRIPTION OF THE DRAWINGS

A more complete appreciation of the embodiments and many of the attendant advantages and features thereof can be readily obtained and understood from the following detailed description with reference to the accompanying drawings, wherein.

Figure 1:
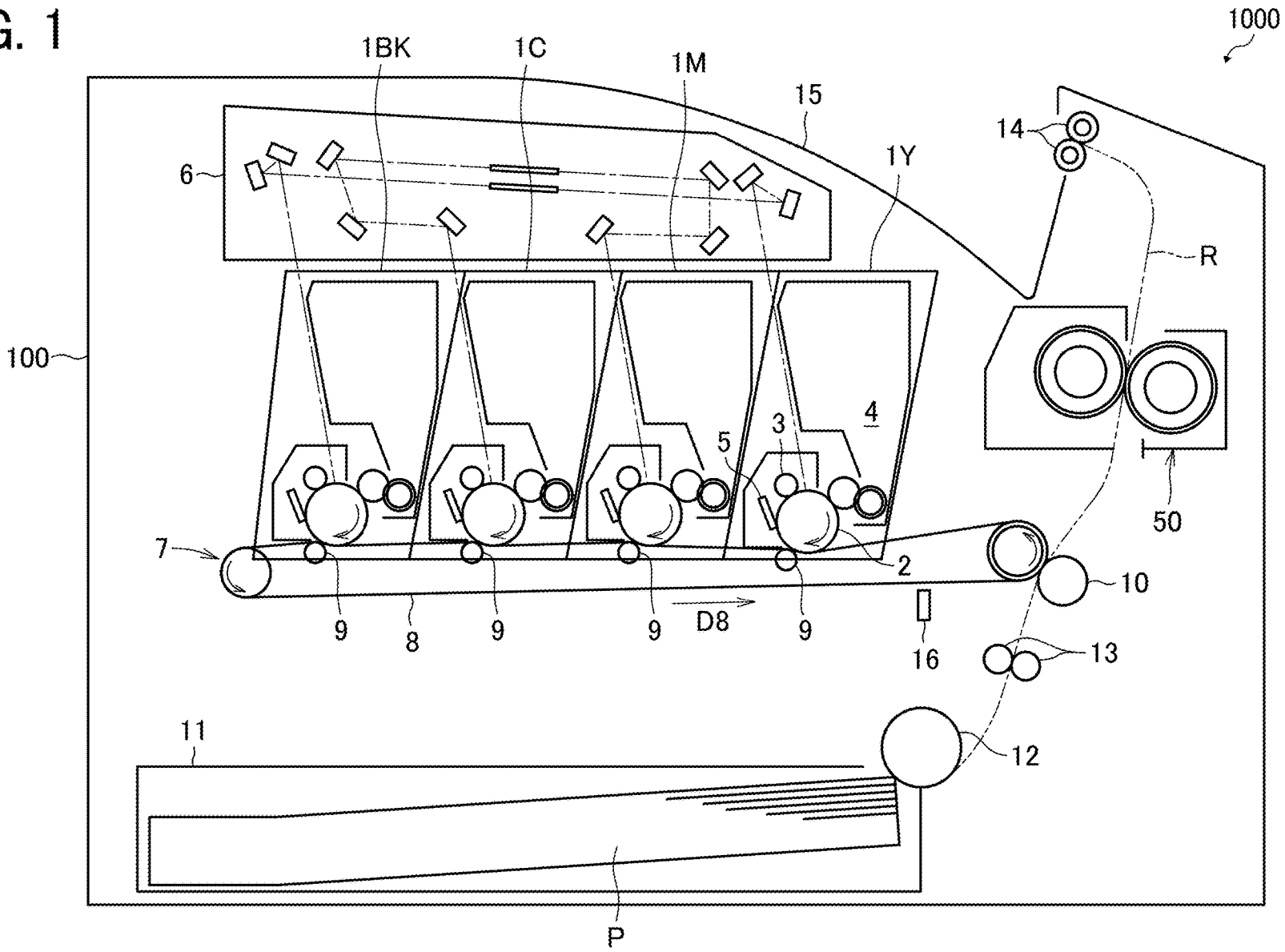
FIG. 1 is a schematic cross-sectional view of an image forming apparatus according to an embodiment of the present disclosure.

The accompanying drawings are intended to depict embodiments of the present disclosure and should not be interpreted to limit the scope thereof. The accompanying drawings are not to be considered as drawn to scale unless explicitly noted. Also, identical or similar reference numerals designate identical or similar components throughout the several views.

DETAILED DESCRIPTION

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

As used herein, the singular forms "a", "an", and "the" are intended to include the plural forms as well, unless the context clearly indicates otherwise.

Referring to drawings, a description is provided of a construction of a fixing device and an image forming apparatus (e.g., a laser printer) incorporating the fixing device according to embodiments of the present disclosure.

A laser printer is one example of the image forming apparatus. The image forming apparatus is not limited to the laser printer. For example, the image forming apparatus may be a copier, a facsimile machine, a printer, a printing machine, an inkjet recording apparatus, or a multifunction peripheral (MFP) having at least two of copying, facsimile, printing, scanning, and inkjet recording functions.

In the drawings, identical reference numerals are assigned to identical elements and equivalents and redundant descriptions of the identical elements and the equivalents are summarized or omitted properly. The dimension, material, shape, relative position, and the like of each of the elements are examples and do not limit the scope of this disclosure unless otherwise specified.

According to the embodiments below, a sheet is used as a recording medium. However, the recording medium is not limited to paper as the sheet. In addition to paper as the sheet, the recording media include an overhead projector (OHP) transparency, cloth, a metal sheet, plastic film, and a prepreg sheet pre-impregnated with resin in carbon fiber.

The recording media also include a medium adhered with a developer or ink, recording paper, and a recording sheet. The sheets include, in addition to plain paper, thick paper, a postcard, an envelope, thin paper, coated paper, art paper, and tracing paper.

Image formation described below denotes forming an image having meaning such as characters and figures and an image not having meaning such as patterns on the medium.

A description is provided of an outline of an image forming apparatus 1000.

FIG. 1 is a schematic cross-sectional view of the image forming apparatus 1000, that is, a color laser printer, according to an embodiment of the present disclosure.

Referring to FIG. 1, a description is provided of a general arrangement and operations of the image forming apparatus 1000, that is, the color laser printer.

As illustrated in FIG. 1, the image forming apparatus 1000 includes four image forming devices 1Y, 1M, 1C, and 1BK disposed in a center portion of an apparatus body 100 of the image forming apparatus 1000. The image forming devices 1Y, 1M, 1C, and 1BK form toner images in different colors, that is, yellow (Y), magenta (M), cyan (C), and black (BK), respectively, which correspond to color separation components for a color image.

Each of the image forming devices 1Y, 1M, 1C, and 1BK includes a photoconductor 2, a charging roller 3, a developing device 4, and a cleaning blade 5. The photoconductor 2 serves as a latent image bearer. The charging roller 3 serves as a charger that charges a surface of the photoconductor 2. The developing device 4 supplies toner onto an electrostatic latent image formed on the surface of the photoconductor 2 to develop the electrostatic latent image into a toner image. The cleaning blade 5 serves as a cleaner that cleans the surface of the photoconductor 2. FIG. 1 assigns reference numerals to the photoconductor 2, the charging roller 3, the developing device 4, and the cleaning blade 5 of the image forming device 1Y that forms a yellow toner image. Reference numerals for elements of the image forming devices 1M, 1C, and 1BK are omitted.

An exposure device 6 is disposed above the image forming devices 1Y, 1M, 1C, and 1BK in FIG. 1. The exposure device 6 serves as a latent image forming device that forms an electrostatic latent image on the surface of the photoconductor 2 of each of the image forming devices 1Y, 1M, 1C, and 1BK. The exposure device 6 includes a light source, a polygon mirror, an f-θ lens, and a reflection mirror. The exposure device 6 irradiates the surface of each of the photoconductors 2 with a laser beam according to image data.

A transfer device 7 is disposed below the image forming devices 1Y, 1M, 1C, and 1BK in FIG. 1. The transfer device 7 serves as a transferor that transfers toner images, that is, yellow, magenta, cyan, and black toner images, formed on the photoconductors 2, respectively, and further transfers the toner images onto a sheet P serving as a recording medium. The transfer device 7 includes an intermediate transfer belt 8 and four primary transfer rollers 9. The intermediate transfer belt 8 is an endless belt serving as a transferor. The primary transfer rollers 9 serve as primary transferors. The intermediate transfer belt 8 is stretched taut across a plurality of support rollers and applied with predetermined tension. As one of the support rollers serving as a driving roller drives and rotates the intermediate transfer belt 8, the intermediate transfer belt 8 rotates in a direction D8.

The four primary transfer rollers 9 are pressed against the photoconductors 2, respectively, via the intermediate transfer belt 8. Thus, the intermediate transfer belt 8 contacts each of the photoconductors 2, forming a primary transfer nip therebetween. The primary transfer rollers 9 transfer the toner images formed on the photoconductors 2, respectively, onto the intermediate transfer belt 8 at the primary transfer nips. Each of the primary transfer rollers 9 is connected to a power supply. The power supply applies at least one of a predetermined direct current (DC) voltage and a predetermined alternating current (AC) voltage to each of the primary transfer rollers 9.

A secondary transfer roller 10 serving as a secondary transferor is disposed opposite the support roller via the intermediate transfer belt 8 and in contact with the intermediate transfer belt 8. Thus, a secondary transfer nip is formed between the secondary transfer roller 10 and the intermediate transfer belt 8. The secondary transfer roller 10 transfers the toner images formed on the intermediate transfer belt 8 onto a sheet P at the secondary transfer nip, thus forming an unfixed full color toner image on the sheet P. Like the primary transfer rollers 9, the secondary transfer roller 10 is connected to the power supply. The power supply applies at least one of the predetermined direct current (DC) voltage and the predetermined alternating current (AC) voltage to the secondary transfer roller 10.

A sheet tray 11, a sheet feeding roller 12, and the like are disposed in a lower portion of the apparatus body 100 in FIG. 1. The sheet tray 11 (e.g., a paper tray) loads sheets P. The sheet feeding roller 12 picks up and feeds a sheet P from the sheet tray 11. The sheet tray 11 and the sheet feeding roller 12 construct a sheet feeding device. The sheets P include thick paper, a postcard, an envelope, plain paper, thin paper, coated paper, art paper, and tracing paper. Further, an overhead projector (OHP) transparency (e.g., an OHP sheet and OHP film) and the like may be used as recording media.

A conveyance path R is disposed inside the apparatus body 100. A sheet P is picked up from the sheet tray 11, conveyed through the conveyance path R via the secondary transfer nip, and ejected onto an outside of the image forming apparatus 1000. A registration roller pair 13 serving as a timing roller pair is disposed in the conveyance path R and disposed upstream from the secondary transfer nip defined by the secondary transfer roller 10 in a sheet conveyance direction in which the sheet P is conveyed.

A fixing device 50 is disposed downstream from the secondary transfer nip defined by the secondary transfer roller 10 in the sheet conveyance direction. The fixing device 50 fixes the unfixed full color toner image transferred from the intermediate transfer belt 8 onto the sheet P thereon. A sheet ejecting roller pair 14 is disposed at a downstream end of the conveyance path R in the sheet conveyance direction. The sheet ejecting roller pair 14 ejects the sheet P onto the outside of the image forming apparatus 1000. An ejected sheet tray 15 (e.g., an output tray) is disposed atop the apparatus body 100. The ejected sheet tray 15 stocks the sheet P ejected onto the outside of the image forming apparatus 1000.

A sensor 16 serving as a pattern detector is disposed opposite an outer circumferential surface of the intermediate transfer belt 8. The sensor 16 is a reflective optical sensor that detects an image pattern that is formed on the intermediate transfer belt 8 and used to detect an image density, misregistration, and the like of toner images.

A description is provided of basic operations of the image forming apparatus 1000.

Referring to FIG. 1, a description is provided of the basic operations of the image forming apparatus 1000 according to this embodiment.

When image formation starts, that is, when the image forming apparatus 1000 receives a print job, a driver drives and rotates the photoconductor 2 of each of the image forming devices 1Y, 1M, 1C, and 1BK clockwise in FIG. 1. The charging roller 3 charges the surface of the photoconductor 2 uniformly at a predetermined polarity. The exposure device 6 irradiates the charged surfaces of the photoconductors 2 with laser beams, respectively, according to image data sent from an external device, forming electrostatic latent images on the surfaces of the photoconductors 2.

The image data used to expose each of the photoconductors 2 is monochrome image data created by decomposing desired full color image data into yellow, magenta, cyan, and black image data. The developing devices 4 supply toners to the electrostatic latent images formed on the photoconductors 2, respectively, visualizing the electrostatic latent images as visible toner images.

When image formation starts, the intermediate transfer belt 8 starts being driven and rotated in the direction D8. Each of the primary transfer rollers 9 is applied with a voltage having a polarity opposite a polarity of charged toner under a constant voltage control or a constant current control. Thus, a transfer electric field is created at each of the primary transfer nips.

Thereafter, when the toner images formed on the photoconductors 2 reach the primary transfer nips in accordance with rotation of the photoconductors 2, respectively, the toner images formed on the photoconductors 2 are transferred onto the intermediate transfer belt 8 successively by the transfer electric fields created at the primary transfer nips such that the toner images are superimposed on the intermediate transfer belt 8, forming a full color toner image. Thus, the full color toner image is borne on the outer circumferential surface of the intermediate transfer belt 8. The cleaning blades 5 remove toner failed to be transferred onto the intermediate transfer belt 8 and therefore remained on the photoconductors 2 therefrom, respectively.

The sheet feeding roller 12 starts being driven and rotated, feeding a sheet P from the sheet tray 11 to the conveyance path R. The registration roller pair 13 conveys the sheet P sent to the conveyance path R to the secondary transfer nip at a time when the full color toner image formed on the intermediate transfer belt 8 reaches the secondary transfer nip. The secondary transfer roller 10 is applied with a transfer voltage having a polarity opposite the polarity of the charged toner of the full color toner image formed on the intermediate transfer belt 8, thus creating a transfer electric field at the secondary transfer nip.

Thereafter, when the full color toner image formed on the intermediate transfer belt 8 reaches the secondary transfer nip in accordance with rotation of the intermediate transfer belt 8, the full color toner image formed on the intermediate transfer belt 8 is transferred onto the sheet P collectively by the transfer electric field created at the secondary transfer nip.

Thereafter, the sheet P is conveyed to the fixing device 50 that fixes the full color toner image on the sheet P. The sheet P is ejected onto the outside of the image forming apparatus 1000 by the sheet ejecting roller pair 14 and stocked on the ejected sheet tray 15.

The above describes image formation to form the full color toner image on the sheet P. Alternatively, one of the four image forming devices 1Y, 1M, 1C, and 1BK may be used to form a monochrome toner image or two or three of the four image forming devices 1Y, 1M, 1C, and 1BK may be used to form a bicolor toner image or a tricolor toner image.

When a controller of the image forming apparatus 1000 adjusts the image density and the misregistration of each of the yellow, magenta, cyan, and black toner images, each of the image forming devices 1Y, 1M, 1C, and 1BK serves as a pattern former that forms an image pattern for detection on the outer circumferential surface of the intermediate transfer belt 8. For example, similar to the above-described basic operations for image formation and image transfer, the image pattern used to detect the image density, the misregistration, and the like of the toner images is formed on the photoconductor 2 of each of the image forming devices 1Y, 1M, 1C, and 1BK. The primary transfer rollers 9 transfer the image patterns formed on the photoconductors 2, respectively, onto the intermediate transfer belt 8 at the primary transfer nips. When the image patterns reach an opposed position where the image patterns are disposed opposite the sensor 16 as the intermediate transfer belt 8 rotates, the sensor 16 detects the image patterns. The controller corrects the image density of the toner images, the position where the toner images are formed on the photoconductors 2 or the intermediate transfer belt 8, and the like based on detection data provided by the sensor 16.

Figure 2A:
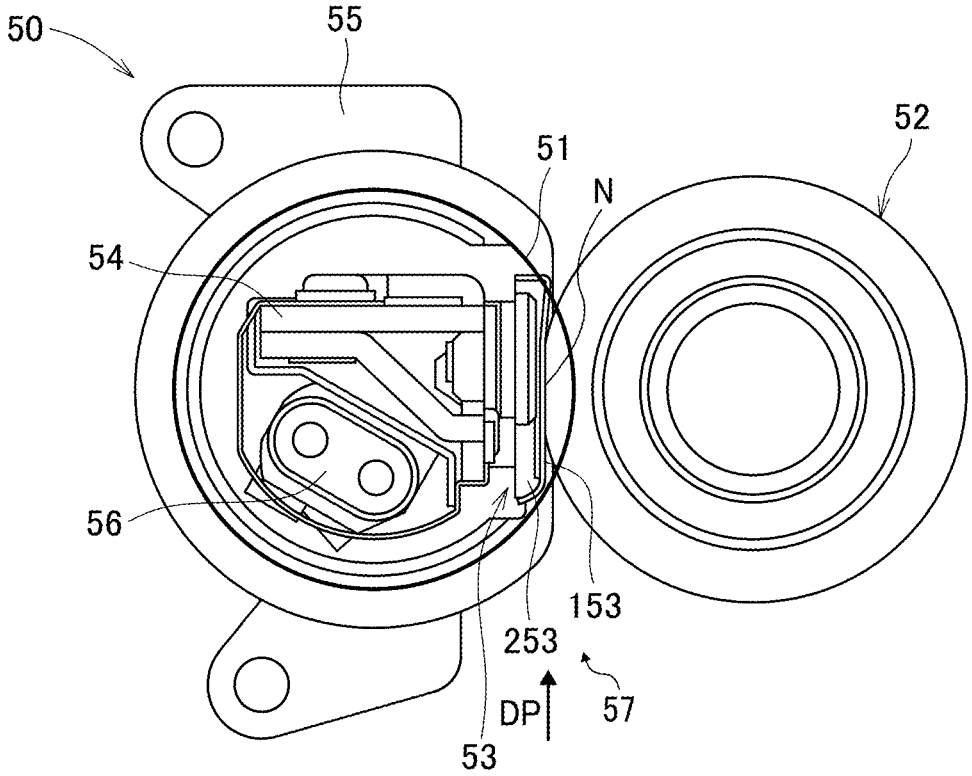
FIG. 2A is a schematic cross-sectional side view of a fixing device incorporated in the image forming apparatus depicted in FIG. 1.

Referring to FIG. 2A, a description is provided of a construction of the fixing device 50.

The fixing device 50 includes a heating device 57 according to an embodiment of the present disclosure.

The fixing device 50 includes a fixing belt 51, a pressure roller 52, a nip former 53, a stay 54, a fixing flange 55, and a halogen heater 56. The fixing belt 51 serves as a rotator, a fixing rotator, or a fixing member that is rotatable. The pressure roller 52 serves as a pressure rotator or a pressure member that is disposed opposite the fixing belt 51 and rotatable. The nip former 53 (e.g., a nip forming pad) is disposed within a loop formed by the fixing belt 51. The stay 54 supports the nip former 53. The fixing flange 55 rotatably guides each lateral end of the fixing belt 51 in an axial direction thereof. The halogen heater 56 serves as a heat source that heats the fixing belt 51.

The nip former 53 includes a thermal conductor 153 and a base 253. The thermal conductor 153 is an enhanced thermal conductor that has an increased thermal conductivity and contacts an inner circumferential surface of the fixing belt 51. The base 253 is supported by the stay 54. Each of the stay 54 and the base 253 is made of a material having a thermal conductivity smaller than a thermal conductivity of the thermal conductor 153. In order to attain rigidity, the stay 54 is made of metal such as aluminum, iron, and stainless steel. The base 253 is made of heat resistant resin that is molded readily.

A detailed description is now given of a construction of the fixing belt 51.

The fixing belt 51 is an endless belt or film that is thin and has flexibility. For example, the fixing belt 51 includes a base layer and a release layer. The base layer is an inner circumferential layer made of metal such as nickel and stainless used steel (SUS) or resin such as polyimide (PI).

The release layer is an outer circumferential layer made of tetrafluoroethylene-perfluoroalkylvinylether copolymer (PFA), polytetrafluoroethylene (PTFE), or the like. Optionally, an elastic layer made of rubber such as silicone rubber, silicone rubber foam, and fluororubber may be interposed between the base layer and the release layer.

A detailed description is now given of a construction of the pressure roller 52.

The pressure roller 52 includes a cored bar, an elastic layer, and a release layer. The elastic layer is disposed on a surface of the cored bar. The release layer is disposed on a surface of the elastic layer. A presser presses the pressure roller 52 toward the fixing belt 51, pressing the pressure roller 52 against the nip former 53 via the fixing belt 51.

At a position where the pressure roller 52 is pressed against the fixing belt 51, the pressure roller 52 and the fixing belt 51 form a fixing nip N having a predetermined length in a sheet conveyance direction DP. A driver such as a motor disposed in the apparatus body 100 drives and rotates the pressure roller 52. As the driver drives and rotates the pressure roller 52, a driving force is transmitted from the pressure roller 52 to the fixing belt 51 at the fixing nip N, rotating the fixing belt 51 in accordance with rotation of the pressure roller 52.

A detailed description is now given of a configuration of the halogen heater 56.

The power supply disposed inside the apparatus body 100 controls output to the halogen heater 56 to generate heat. The output to the halogen heater 56 is controlled based on a temperature of a surface of the fixing belt 51, which is detected by a temperature sensor. Such control of the output to the halogen heater 56 adjusts the temperature, that is, a fixing temperature, of the fixing belt 51 to a desired temperature. Alternatively, as a heat source that heats the fixing belt 51, an induction heater (IH) including an IH coil, a resistive heat generator (e.g., a laminated heat generator), a carbon heater, or the like may be employed instead of the halogen heater 56.

A description is provided of a construction of a comparative nip former.

The comparative nip former includes a thin metal plate having an increased thermal conductivity (e.g., a front thermal equalizing plate) and a thick metal plate having an increased thermal conductivity (e.g., a back thermal equalizing plate). The front thermal equalizing plate serving as a thermal conduction aid is disposed opposite a fixing belt. The back thermal equalizing plate is mounted on a back face of a base of the comparative nip former. In order to even a temperature distribution of the fixing belt quickly, the front thermal equalizing plate is thin and has a thickness in a range of from about 0.4 mm to about 1 mm in view of thermal equalization rather than thermal capacity.

Conversely, since the base is interposed between the front thermal equalizing plate and the back thermal equalizing plate, the back thermal equalizing plate is thick and has a thickness in a range of from about 1 mm to about 2 mm in view of thermal capacity rather than thermal equalization. Heat is conducted to a stay through the back thermal equalizing plate.

However, an actual value of thermal conduction between the front thermal equalizing plate and the back thermal equalizing plate may be smaller than a theoretical value.

Thermal equalization may be substantially restricted to a longitudinal direction of the front thermal equalizing plate. A first main factor is that each of the front thermal equalizing plate and the back thermal equalizing plate has surface properties (e.g., surface roughness and a foreign substance). A second main factor is that the comparative nip former suffers from increase and unevenness in contact thermal resistance due to a tolerance in the thickness of the back thermal equalizing plate and an increased number of parts.

A detailed description is now given of a construction of the nip former 53.

Figure 2B:
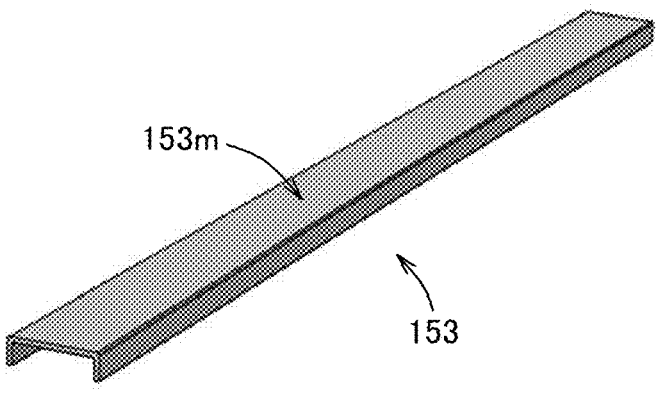
FIG. 2B is a perspective view of a thermal conductor incorporated in the fixing device depicted in FIG. 2A, illustrating a belt side face of the thermal conductor.

FIG. 2B is a perspective view of the thermal conductor 153, illustrating a belt side face 153*m* that faces the fixing belt 51. As illustrated in FIG. 2B, the nip former 53 includes the thermal conductor 153 made of a sheet metal that is U-shaped in cross section. In order to even a temperature distribution quickly, the thermal conductor 153 is preferably made of a material having an increased thermal conductivity such as gold, silver, copper, and graphite. According to this embodiment, the thermal conductor 153 is made of native copper in view of manufacturing costs, processability, and strength.

Figure 2C:
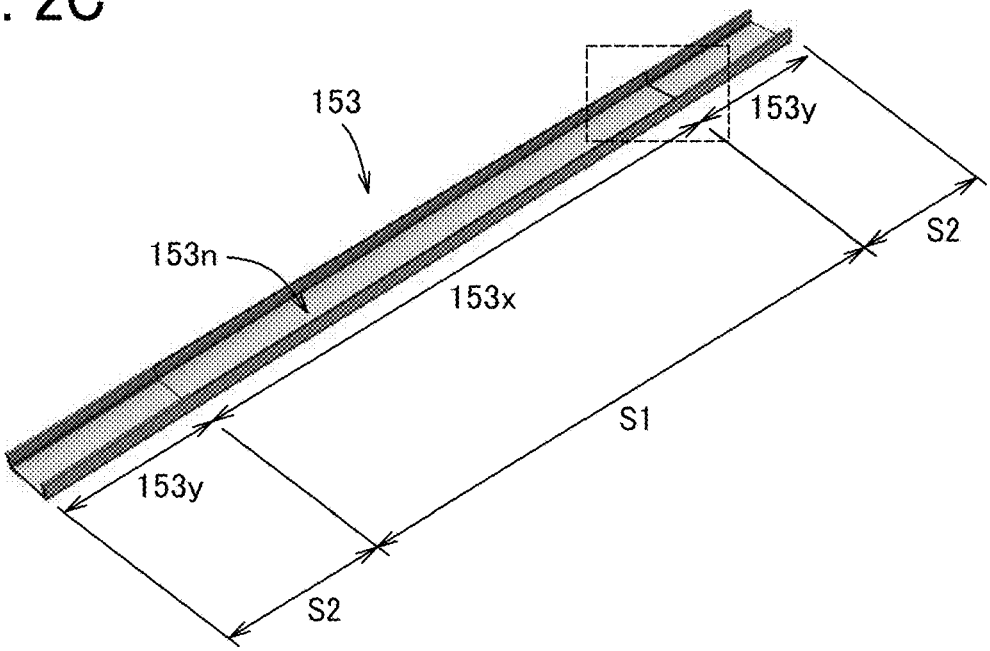
FIG. 2C is a perspective view of the thermal conductor depicted in FIG. 2B, illustrating a stay side face of the thermal conductor, that is opposite the belt side face.

FIG. 2C is a perspective view of the thermal conductor 153, illustrating a stay side face 153*n* that faces the stay 54. As illustrated in FIG. 2C, the thermal conductor 153 includes a decreased thickness portion 153*x* and increased thickness portions 153*y*. The decreased thickness portion 153*x* serves as a first thickness portion disposed in a center span S1 of the thermal conductor 153 in a longitudinal direction thereof. The increased thickness portions 153*y* serve as second thickness portions disposed in both lateral end spans S2 of the thermal conductor 153, respectively, in the longitudinal direction thereof. A thickness of the decreased thickness portion 153*x* is smaller than a thickness of each of the increased thickness portions 153*y*. A length of the decreased thickness portion 153*x* in the longitudinal direction of the thermal conductor 153 is equivalent to a width of a small sheet P, that is, the center span S1.

Figure 2D:
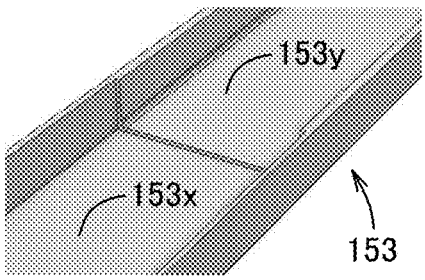
FIG. 2D is an enlarged perspective view of the thermal conductor depicted in FIG. 2C, illustrating an increased thickness portion of the thermal conductor.

Sheets P having a plurality of sizes are conveyed over the center span S1 of the thermal conductor 153 in the longitudinal direction thereof via the fixing belt 51 so that toner images are fixed on the sheets P. The center span S1 of the thermal conductor 153 in the longitudinal direction thereof is situated away from a part of the fixing belt 51 in each lateral end span S2, where overheating is requested to be suppressed. Hence, the center span S1 of the thermal conductor 153 in the longitudinal direction thereof is requested to facilitate quick warm-up of the fixing belt 51 rather than thermal equalization of the fixing belt 51. To address this circumstance, the decreased thickness portion 153*x* having a decreased thermal capacity is disposed in the center span S1 of the thermal conductor 153 in the longitudinal direction thereof. Conversely, as illustrated in FIG. 2D, the increased thickness portions 153*y* having an increased thermal capacity are disposed in both lateral end spans S2 of the thermal conductor 153 in the longitudinal direction thereof, respectively, so as to suppress overheating of both lateral end spans S2 of the fixing belt 51 in the axial direction thereof.

A description is provided of a construction of the increased thickness portions 153*y* disposed in both lateral end spans S2 of the thermal conductor 153, respectively, in the longitudinal direction thereof.

A description is now given of a construction of the nip former 53 according to a first embodiment of the present disclosure.

FIGS. 3A, 3B, 3C, and 3D illustrate a construction of the increased thickness portions 153*y* of the thermal conductor 153 of the nip former 53 according to the first embodiment of the present disclosure. The thermal conductor 153 includes a center portion 153*a* disposed in the center span S1 of the thermal conductor 153 in the longitudinal direction thereof. The center portion 153*a* has a first thickness portion. The first thickness portion has a thickness of 0.5 mm.

One lateral end portion of the thermal conductor 153, that extends outward and has a predetermined length in the longitudinal direction of the thermal conductor 153, is bent inward toward another lateral end portion of the thermal conductor 153 in the longitudinal direction thereof and laid on the stay side face 153*n* opposite the belt side face 153*m* that contacts the fixing belt 51 serving as a rotator. The predetermined length of the one lateral end portion is equivalent to the length of the increased thickness portion 153*y* depicted in FIG. 2C. Thus, a folded portion 153*b* serving as a second thickness portion is disposed in each lateral end span S2 of the thermal conductor 153 in the longitudinal direction thereof. The second thickness portion has a thickness of 1.0 mm.

The folded portion 153*b* includes a bent portion 153*c* disposed at a lateral edge of the thermal conductor 153 in the longitudinal direction thereof. The folded portion 153*b* further includes a folded end 153*d* that is adjacent to a lateral edge of the center portion 153*a* in the longitudinal direction of the thermal conductor 153. The folded end 153*d* extends in a direction that is perpendicular to the longitudinal direction of the thermal conductor 153 and parallel to the sheet conveyance direction DP depicted in FIG. 2A in which the sheet P is conveyed in the conveyance path R depicted in FIG. 1.

A length of the folded portion 153*b* in a short direction perpendicular to the longitudinal direction of the thermal conductor 153 is substantially equivalent to a length of the fixing nip N in a short direction thereof. If the length of the folded portion 153*b* in the short direction of the thermal conductor 153 is within plus or minus 10% of the length of the fixing nip N in the short direction thereof, for example, the length of the folded portion 153*b* is substantially equivalent to the length of the fixing nip N. Accordingly, the folded portion 153*b* has an area, a volume, and a thermal capacity that are increased as much as possible, suppressing overheating and the like of each lateral end span S2 of the fixing belt 51 in the axial direction thereof.

The bent portion 153*c* is bent by hemming. Hemming is processing of folding a sheet metal by 180 degrees and then stamping the sheet metal. Hemming is also called crashing and bending. Hemming achieves outstanding advantages below.

As a first advantage, each lateral end span S2 of the thermal conductor 153 as a plate in the longitudinal direction thereof has a doubled thickness and an increased thermal capacity.

As a second advantage, the folded portion 153*b* includes a first inner face and a second inner face that contacts the first inner face. Since the first inner face and the second inner face have an identical surface property (e.g., an identical surface roughness), the first inner face adheres to the second inner face properly, enhancing thermal conduction between the first inner face and the second inner face that contacts the first inner face in a thickness direction of the thermal conductor 153.

As a third advantage, the bent portion 153*c* includes a bent top that is round, enhancing a mechanical strength of the thermal conductor 153.

As a fourth advantage, hemming is simple processing performed readily. Hemming does not generate material waste and provides an increased yield of a material.

As a fifth advantage, a round face of the bent top of the bent portion 153*c* improves safety, preventing the bent portion 153*c* from breaking a lateral end of the fixing belt 51 in the axial direction thereof, for example.

Figure 3A:
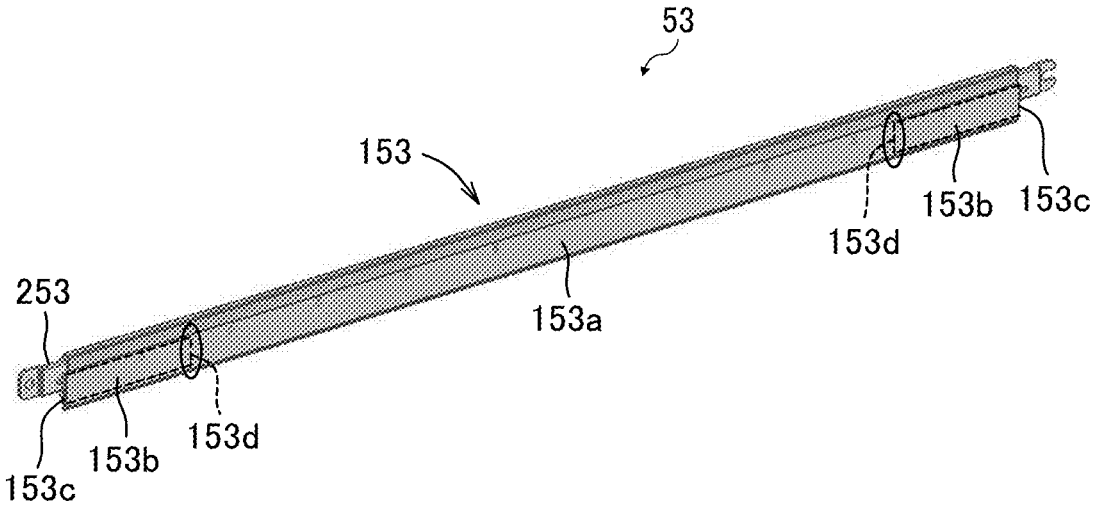
FIG. 3A is a perspective view of a nip former according to a first embodiment of the present disclosure, that is incorporated in the fixing device depicted in FIG. 2A.
Figure 3B:
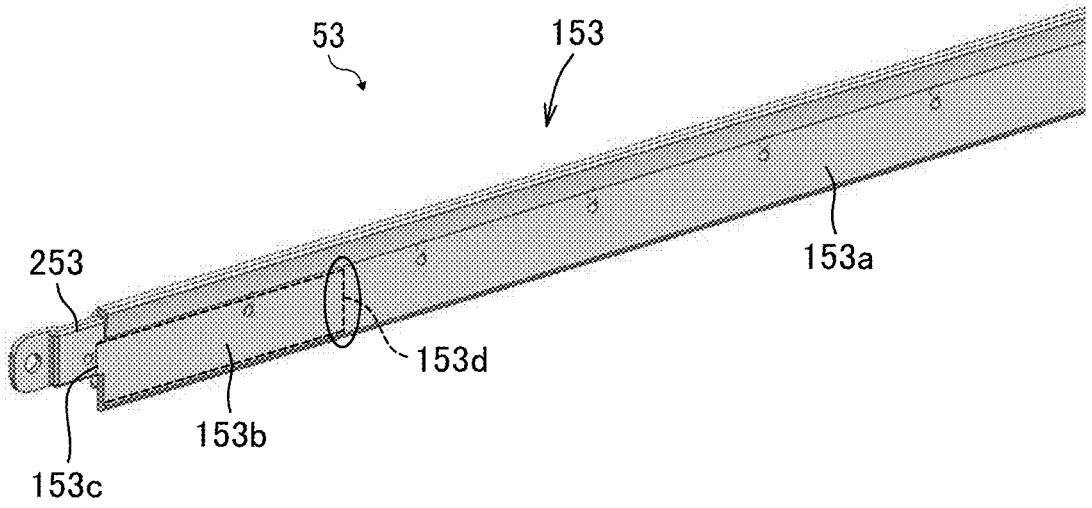
FIG. 3B is a perspective view of the nip former depicted in FIG. 3A, illustrating a lateral end span of the nip former in a longitudinal direction thereof.
Figure 3C:
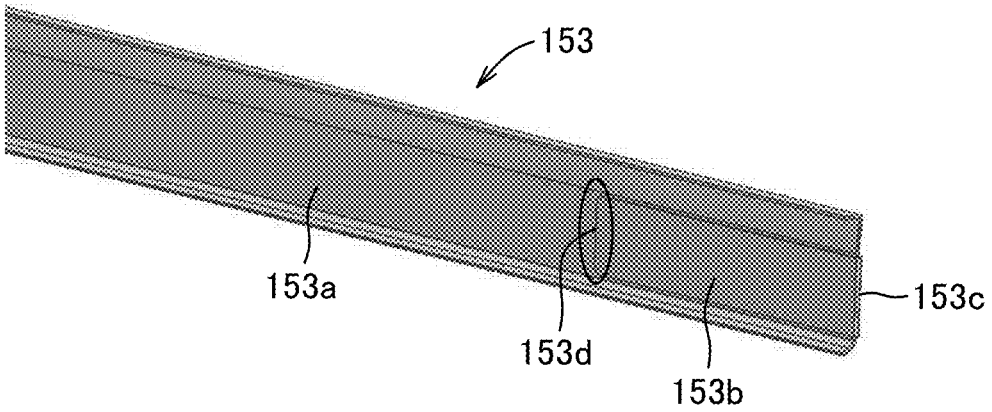
FIG. 3C is a perspective view of the thermal conductor of the nip former depicted in FIG. 3B, illustrating the lateral end span of the nip former in the longitudinal direction thereof on the stay side face of the thermal conductor.
Figure 3D:
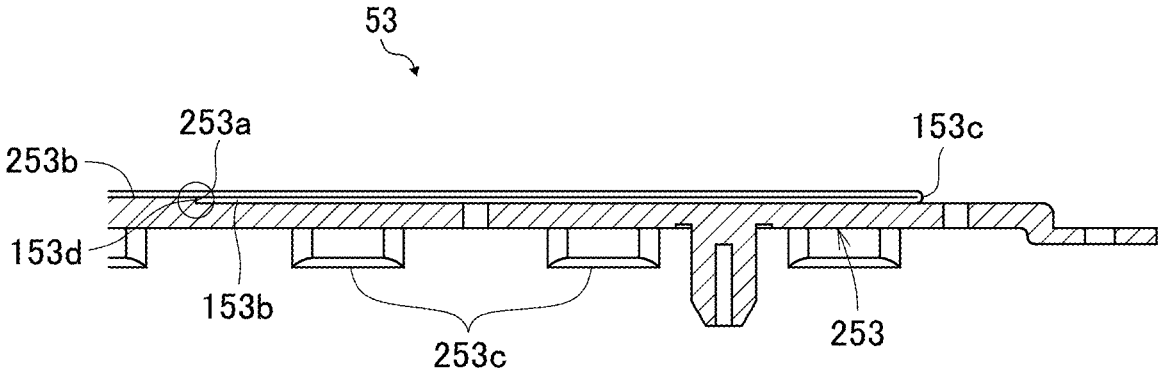
FIG. 3D is a cross-sectional view of the nip former depicted in FIG. 3B, illustrating the lateral end span of the nip former in the longitudinal direction thereof.

As illustrated in FIG. 3D, the folded end 153*d* of the folded portion 153*b* is used to position the thermal conductor 153. For example, the base 253 includes a projection 253*b* disposed opposite the fixing nip N. The projection 253*b* supports the center portion 153*a* in the longitudinal direction of the thermal conductor 153. A step 253*a* (e.g., an engraved step), serving as a positioner, is disposed on each lateral end of the projection 253*b* in the longitudinal direction of the thermal conductor 153. The step 253*a* contacts the folded end 153*d* of the folded portion 153*b*. A height of the step 253*a* is equivalent to a thickness of the thermal conductor 153.

Thus, the step 253*a* supports the thermal conductor 153 without a gap therebetween.

As described above, the folded end 153*d* of the folded portion 153*b* contacts the step 253*a*, restricting the position of the thermal conductor 153 with respect to the base 253 in the longitudinal direction of the thermal conductor 153. As illustrated in FIG. 3D, the base 253 includes a plurality of legs 253*c* that contacts the stay 54 depicted in FIG. 2A. The legs 253*c* prevent heat from being retained between the base 253 and the stay 54.

Generally, engagements having complex shapes, such as a hole, an embossment, a slot, and a projection, are machined or manufactured in a thermal conductor and a base so that the engagements position the thermal conductor in a longitudinal direction thereof. Conversely, the thermal conductor 153 and the base 253 according to this embodiment do not have the engagements having the complex shapes, improving yields of materials and simplifying processes.

A description is provided of a construction of a nip former 53S according to a second embodiment of the present disclosure.

Figure 4A:
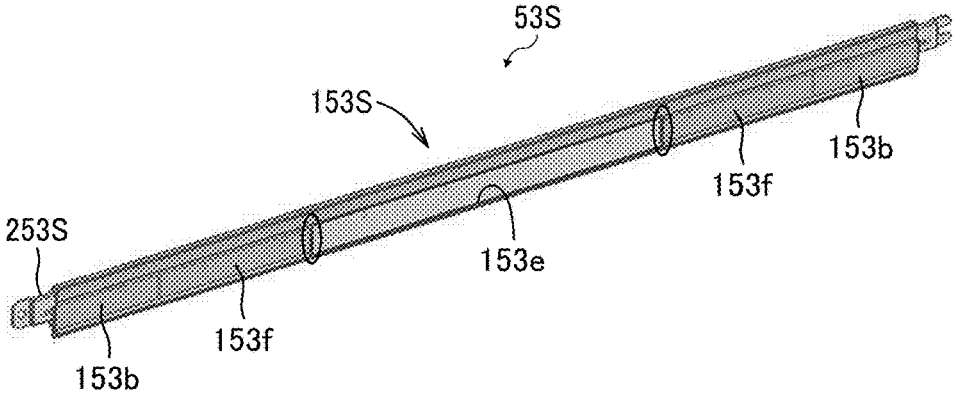
FIG. 4A is a perspective view of a nip former according to a second embodiment of the present disclosure, that is installable in the fixing device depicted in FIG. 2A.
Figure 4B:
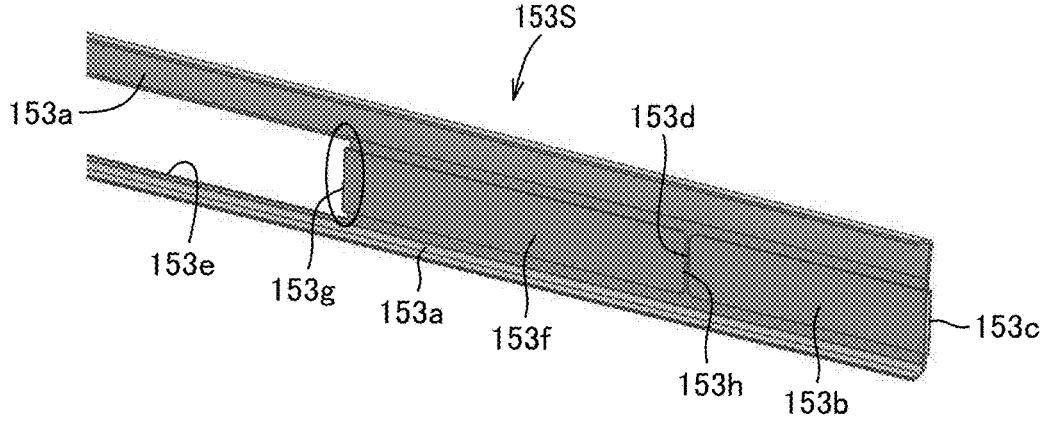
FIG. 4B is a perspective view of a thermal conductor incorporated in the nip former depicted in FIG. 4A, illustrating a lateral end span of the thermal conductor in a longitudinal direction thereof on the stay side face of the thermal conductor.
Figure 4C:
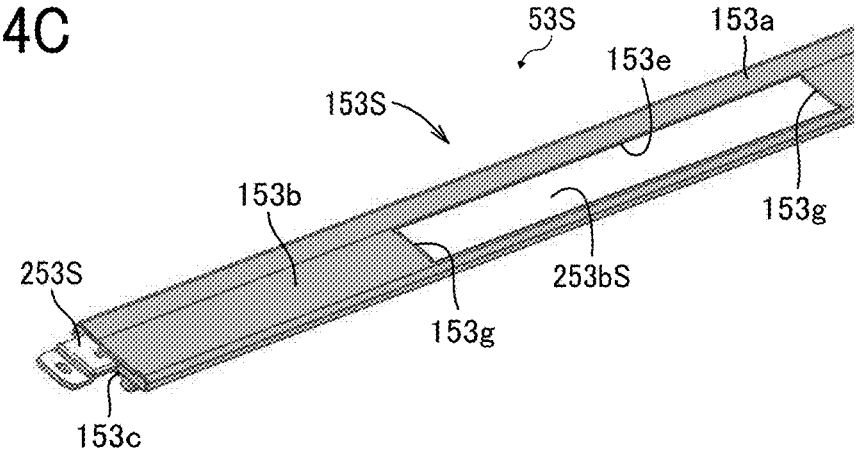
FIG. 4C is a perspective view of the nip former depicted in FIG. 4A, illustrating the lateral end span of the thermal conductor in the longitudinal direction thereof on the belt side face of the thermal conductor.

FIGS. 4A, 4B, and 4C illustrate a thermal conductor 153S of the nip former 53S according to the second embodiment. The thermal conductor 153S according to the second embodiment includes a slot 153*e* disposed in the center span S1 of the thermal conductor 153S in a longitudinal direction thereof. The slot 153*e* is rectangular.

Sheets P having a plurality of sizes are conveyed over the center span S1 of the thermal conductor 153S in the longitudinal direction thereof via the fixing belt 51 so that toner images are fixed on the sheets P. Since the sheets P draw heat in a certain amount from the center span S1 of the fixing belt 51 disposed opposite the center span S1 of the thermal conductor 153S, the center span S1 of the fixing belt 51 does not suffer from rapid temperature increase unlike both lateral end spans S2 of the fixing belt 51 in the axial direction thereof. The center span S1 of the thermal conductor 153S in the longitudinal direction thereof is situated away from a part of the fixing belt 51 in each lateral end span S2, where overheating is requested to be suppressed.

Hence, the center span S1 of the thermal conductor 153S in the longitudinal direction thereof is requested to facilitate quick warm-up of the fixing belt 51 rather than thermal equalization of the fixing belt 51. To address this circumstance, the thermal conductor 153S incorporates the slot 153*e* that decreases the thermal capacity of the thermal conductor 153S. A metal member not disposed in the center span S1 of the thermal conductor 153S in the longitudinal direction thereof does not differentiate the thermal conductor 153S substantially from a thermal conductor having the metal member in a center span of the thermal conductor in a longitudinal direction thereof in view of thermal equalization.

Conversely, the metal member disposed in the center span of the thermal conductor in the longitudinal direction thereof may adversely add a process of thermal conduction, slowing temperature increase of the fixing belt 51. The thermal conductor 153S illustrated in FIGS. 4A, 4B, and 4C that is made of a single sheet metal attains both advantages, that is, an advantage of the center span S1 that avoids the addition of the process of thermal conduction and another advantage of suppressing overheating of both lateral end spans S2 of the fixing belt 51 in the axial direction thereof.

The slot 153*e* of the thermal conductor 153S according to the second embodiment is produced by treating a sheet metal with blanking. A portion of the sheet metal, that is produced as material waste, is used as a folded portion 153*f* that suppresses overheating of each lateral end span S2 of the fixing belt 51 in the axial direction thereof. For example, a punched portion of the sheet metal is bent from an edge of each lateral end of the slot 153*e* in the longitudinal direction of the thermal conductor 153S toward each lateral end of the thermal conductor 153S in the longitudinal direction thereof. The punched portion is folded on the sheet metal to produce the folded portion 153*f*. For example, the folded portion 153*f* includes a bent portion 153*g* that abuts on the lateral end of the slot 153*e* in the longitudinal direction of the thermal conductor 153S.

The folded portion 153*f* includes a folded end 153*h* that is adjacent to and disposed opposite the folded end 153*d* of the folded portion 153*b* disposed outboard from the folded portion 153*f* in the longitudinal direction of the thermal conductor 153S. A combined area of the two folded portions, that is, a combined area combining an area of the folded portion 153*b* and an area of the folded portion 153*f*, is greater than an area of the slot 153*e*. The folded portion 153*b* is contiguous to the folded portion 153*f* in the longitudinal direction of the thermal conductor 153S, increasing the thermal capacity of the thermal conductor 153S as much as possible and suppressing overheating and the like of each lateral end span S2 of the fixing belt 51 in the axial direction thereof further.

The folded portion 153*f* is added at a position disposed inboard from the folded portion 153*b* in the longitudinal direction of the thermal conductor 153S. Accordingly, a combined length combining a length of the folded portion 153*b* and a length of the folded portion 153*f* is greater than the center span S1 of the thermal conductor 153S in the longitudinal direction thereof. Hence, the folded portions 153*b* and 153*f* attain an increased thermal capacity, suppressing overheating of each lateral end span S2 of the fixing belt 51 in the axial direction thereof more effectively.

As illustrated in FIG. 4C, a projection 253*b*S of a base 253S engages an interior of the slot 153*e*. Accordingly, the bent portion 153*g* (e.g., a round face of a bent top) of the folded portion 153*f* contacts a step (e.g., an engraved step) of the projection 253*b*S, that is disposed at each lateral end of the projection 253*b*S in the longitudinal direction of the thermal conductor 153S, thus positioning the thermal conductor 153S in the longitudinal direction thereof.

A height of the step of the projection 253*b*S is twice as great as a thickness of the thermal conductor 153S as a plate unlike the step 253*a* depicted in FIG. 3D. Accordingly, the projection 253*b*S of the base 253S is leveled with a nip side face of the thermal conductor 153S, that is disposed opposite the fixing nip N, attaining smoothness of the nip side face of the thermal conductor 153S.

A description is provided of a construction of a nip former 53T according to a third embodiment of the present disclosure.

Figure 5A:
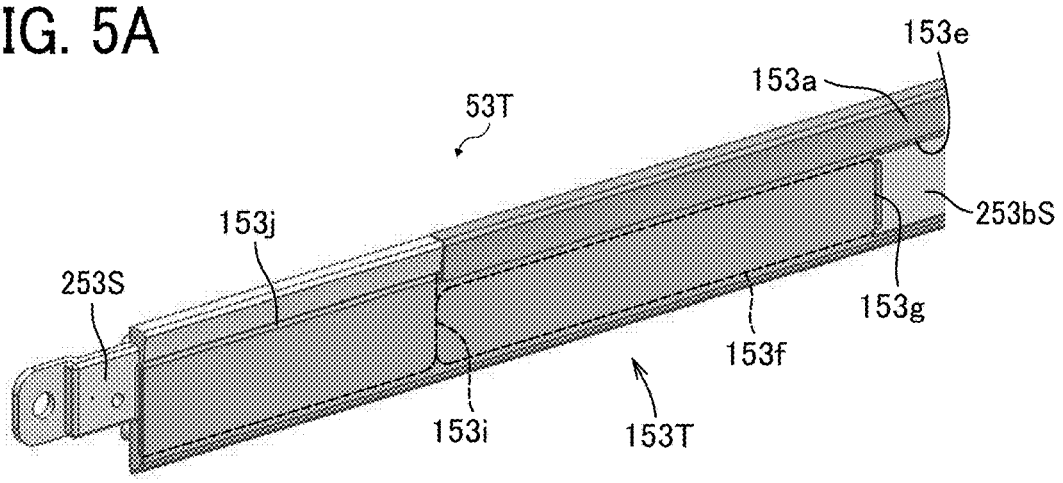
FIG. 5A is a perspective view of a nip former according to a third embodiment of the present disclosure, that is installable in the fixing device depicted in FIG. 2A, illustrating a lateral end span of a thermal conductor of the nip former in a longitudinal direction of the thermal conductor on the belt side face of the thermal conductor.
Figure 5B:
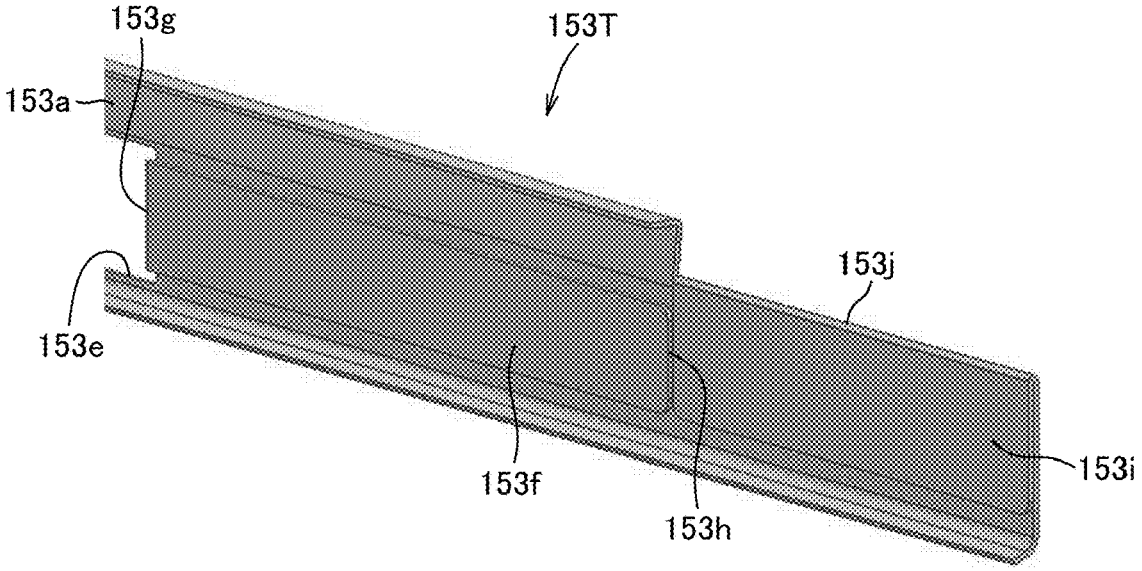
FIG. 5B is a perspective view of the thermal conductor incorporated in the nip former depicted in FIG. 5A, illustrating the lateral end span of the thermal conductor in the longitudinal direction thereof on the stay side face of the thermal conductor.

FIGS. 5A and 5B illustrate a thermal conductor 153T of the nip former 53T according to the third embodiment. The thermal conductor 153T according to the third embodiment includes a folded portion 153*i* that is different from the folded portion 153*b* of the thermal conductor 153S according to the second embodiment depicted in FIG. 4B. For example, as illustrated in FIGS. 5A and 5B, the folded portion 153*i* is bent in a short direction perpendicular to a longitudinal direction of the thermal conductor 153T.

The folded portion 153*i* includes a bent portion 153*j* that is parallel to the longitudinal direction of the thermal conductor 153T and disposed at an edge of the folded portion 153*i* in the short direction of the thermal conductor 153T. The folded end 153*h* of the folded portion 153*f* is adjacent to an inboard edge of the folded portion 153*i* in the longitudinal direction of the thermal conductor 153T. The two folded portions 153*f* and 153*i* are contiguous to each other in the longitudinal direction of the thermal conductor 153T. For example, the folded portion 153*f* is contiguous to the folded portion 153*i* in the longitudinal direction of the thermal conductor 153T, increasing the thermal capacity of the thermal conductor 153T as much as possible and suppressing overheating and the like of each lateral end span S2 of the fixing belt 51 in the axial direction thereof further.

A description is provided of restriction of overheating of each lateral end span S2 of the fixing belt 51 in the axial direction thereof.

Figure 6:
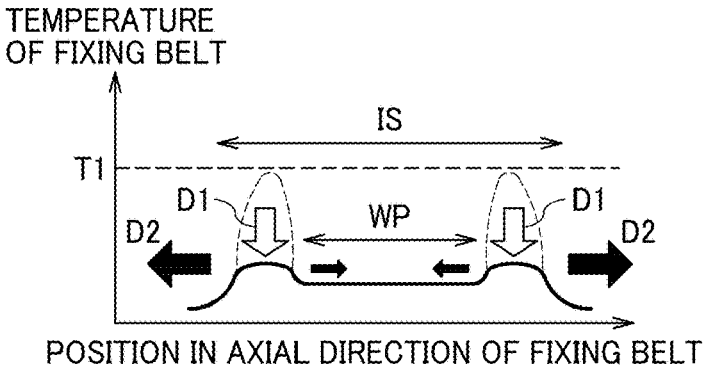
FIG. 6 is a graph illustrating a temperature distribution of a fixing belt incorporated in the fixing device depicted in FIG. 2A in an axial direction of the fixing belt.

As described above, a thermal conductor (e.g., the thermal conductors 153, 153S, and 153T) includes a folded portion (e.g., the folded portions 153*b*, 153*f*, and 153*i*) that is produced by bending a sheet metal by hemming, thus suppressing overheating of each lateral end span S2 of the fixing belt 51 in the axial direction thereof. FIG. 6 is a graph illustrating restriction of overheating of each lateral end span S2 of the fixing belt 51 in the axial direction thereof. In FIG. 6, Ti represents a heat resistant temperature of the fixing belt 51. IS represents an irradiation span of the halogen heater 56. WP represents a width of a small sheet Pin the axial direction of the fixing belt 51. D2 represents a direction in which heat dissipates. A curved dotted line in FIG. 6 represents temperature increase in a non-conveyance span of the fixing belt 51 where small sheets P are not conveyed. The non-conveyance span is disposed in each lateral end span S2 of the fixing belt 51 in the axial direction thereof. After the small sheets P are conveyed, the non-conveyance span suffers from temperature increase because the small sheets P do not draw heat from the non-conveyance span. As indicated with downward arrows in FIG. 6, that is, directions D1, a folded portion (e.g., the folded portions 153*b*, 153*f*, and 153*i*) of a thermal conductor (e.g., the thermal conductors 153, 153S, and 153T) suppresses temperature increase of the non-conveyance span of the fixing belt 51 as illustrated with a solid line in FIG. 6, thus improving productivity when the small sheets P are conveyed over the fixing belt 51 continuously.

Each of the thermal conductors 153, 153S, and 153T according to the first, second, and third embodiments, respectively, as a single part, suppresses temperature increase of the non-conveyance span of the fixing belt 51 when the small sheets P are conveyed, thus retaining productivity when the small sheets P are conveyed continuously. Accordingly, the fixing device 50 incorporating the thermal conductor 153, 153S, or 153T and the image forming apparatus 1000 incorporating the fixing device 50 do not suffer from degradation in a temperature increase speed, such as a warm-up time, that has a trade-off relation with restriction of temperature increase of the non-conveyance span of the fixing belt 51 in general fixing devices. Each of the thermal conductors 153, 153S, and 153T, that is, a front thermal equalizing plate as a single part, performs thermal equalization exclusively. Each of the thermal conductors 153, 153S, and 153T as a single plate eliminates an influence of a thermal resistance between the fixing belt 51 and each of the thermal conductors 153, 153S, and 153T, that contacts the fixing belt 51, as much as possible, thus enhancing thermal conduction, improving machining, and reducing manufacturing costs.

The above describes the embodiments of the present disclosure specifically. However, the technology of the present disclosure is not limited to the embodiments described above and is modified within the scope of the present disclosure. For example, the heating device 57 according to the embodiments of the present disclosure is also applicable to a dryer installed in an image forming apparatus employing an inkjet method instead of the fixing device 50. The dryer dries ink applied onto a sheet. Alternatively, the heating device 57 according to the embodiments of the present disclosure may be applied to a coater (e.g., a laminator) that thermally presses film as a coating member onto a surface of a sheet (e.g., paper) while a belt conveys the sheet. A folded portion (e.g., the folded portions 153*b*, 153*f*, and 153*i*) of a thermal conductor (e.g., the thermal conductors 153, 153S, and 153T) may be constructed of a sheet metal in two or more layers.

A description is provided of advantages of a heating device (e.g., the heating device 57).

As illustrated in FIG. 2A, the heating device includes a tubular rotator (e.g., the fixing belt 51), a heat source (e.g., the halogen heater 56), and a thermal conductor (e.g., the thermal conductors 153, 153S, and 153T). The heating device may further include a nip former (e.g., the nip former 53), a support (e.g., the stay 54), and a pressure rotator (e.g., the pressure roller 52).

The tubular rotator rotates. The heat source heats the tubular rotator. The nip former extends in a longitudinal direction that is parallel to an axial direction of the tubular rotator. The nip former is disposed opposite an inner circumferential surface of the tubular rotator. The support supports the nip former. The pressure rotator presses against the nip former via the tubular rotator to form a nip (e.g., the fixing nip N) between the tubular rotator and the pressure rotator. The tubular rotator conducts heat to a heating object (e.g., a sheet P) conveyed through the nip.

As illustrated in FIGS. 3A, 4A, and 5A, the nip former includes the thermal conductor (e.g., the thermal conductors 153, 153S, and 153T) that has a first face (e.g., the belt side face 153*m*) that contacts the tubular rotator. The thermal conductor has a thermal conductivity greater than a thermal conductivity of the support.

As illustrated in FIG. 2C, the thermal conductor includes a first thickness portion (e.g., the decreased thickness portion 153*x*) disposed in a first span (e.g., the center span S1) of the thermal conductor in the longitudinal direction of the nip former (e.g., a longitudinal direction of the thermal conductor). The first thickness portion has a first thickness. The thermal conductor further includes a second thickness portion (e.g., the increased thickness portion 153*y*) disposed in at least a part of a second span (e.g., the lateral end span S2) of the thermal conductor in the longitudinal direction of the nip former. The second span is different from the first span. The second thickness portion has a second thickness greater than the first thickness of the first thickness portion.

As illustrated in FIGS. 3C, 4B, and 5B, the second thickness portion includes a folded portion (e.g., the folded portions 153*b*, 153*f*, and 153*i*) disposed on a second face (e.g., the stay side face 153*n*) of the thermal conductor, that is opposite the first face. The folded portion includes a bent portion (e.g., the bent portions 153*c* and 153*g*) disposed at a lateral edge of the second thickness portion in the longitudinal direction of the nip former. The folded portion has a predetermined length from the lateral edge of the second thickness portion toward another lateral edge of the second thickness portion in the longitudinal direction of the nip former. For example, a part of the second thickness portion, that has the predetermined length, is folded on the second face to define the folded portion.

Accordingly, the thermal conductor has a simple structure that decreases the number of parts, the number of materials, the thermal resistance between the thermal conductor and the tubular rotator that contacts the thermal conductor, and manufacturing costs.

The fixing device 50 employs a center conveyance system in which a recording medium is aligned along a center of the fixing belt 51 in the axial direction thereof, producing the non-conveyance span (e.g., the lateral end span S2) in each lateral end of the fixing belt 51 in the axial direction thereof. Alternatively, the fixing device 50 may employ a lateral end conveyance system in which a recording medium is aligned along one lateral end of the fixing belt 51 in the axial direction thereof, producing the non-conveyance span in another lateral end of the fixing belt 51 in the axial direction thereof.

According to the embodiments described above, the fixing belt 51 serves as a tubular rotator. Alternatively, a fixing film, a fixing sleeve, or the like may be used as a tubular rotator. Further, the pressure roller 52 serves as a pressure rotator. Alternatively, a pressure belt or the like may be used as a pressure rotator.

According to the embodiments described above, the image forming apparatus 1000 is a printer. Alternatively, the image forming apparatus 1000 may be a copier, a facsimile machine, a multifunction peripheral (MFP) having at least two of printing, copying, facsimile, scanning, and plotter functions, an inkjet recording apparatus, or the like.

The above-described embodiments are illustrative and do not limit the present disclosure. Thus, numerous additional modifications and variations are possible in light of the above teachings. For example, elements and features of different illustrative embodiments may be combined with each other and substituted for each other within the scope of the present disclosure.

Any one of the above-described operations may be performed in various other ways, for example, in an order different from the one described above.

What is claimed is:

1. A heating device comprising:

a tubular rotator configured to rotate;

a heat source configured to heat the tubular rotator; and a thermal conductor including:

a first face contacting the tubular rotator;

a second face being opposite the first face;

a first thickness portion disposed in a first span of the thermal conductor in a longitudinal direction of the thermal conductor, the first thickness portion having a first thickness; and a second thickness portion disposed in at least a part of a second span of the thermal conductor in the longitudinal direction of the thermal conductor, the second span being different from the first span, the second thickness portion having a second thickness greater than the first thickness of the first thickness portion, the second thickness portion including a folded portion disposed on the second face, wherein the folded portion includes a bent portion disposed at a lateral edge of the second thickness portion in the longitudinal direction of the thermal conductor, and wherein the folded portion has a predetermined length from the lateral edge of the second thickness portion toward another lateral edge of the second thickness portion in the longitudinal direction of the thermal conductor.

2. The heating device according to claim 1, wherein the bent portion is bent by hemming.

3. The heating device according to claim 1, wherein the thermal conductor is made of a plate, and wherein the folded portion is made of the plate that is folded in two layers contacting each other.

4. The heating device according to claim 1, wherein the thermal conductor further includes a slot disposed in the first span of the thermal conductor in the longitudinal direction of the thermal conductor.

5. The heating device according to claim 4, wherein an area of the folded portion is greater than an area of the slot.

6. The heating device according to claim 4, wherein the second thickness portion further includes another folded portion that is disposed on the second face of the thermal conductor, said another folded portion including a bent portion abutting on a lateral end of the slot in the longitudinal direction of the thermal conductor.

7. The heating device according to claim 6, wherein said another folded portion is adjacent to the folded portion in the longitudinal direction of the thermal conductor.

8. The heating device according to claim 1, wherein the folded portion includes a bent portion disposed at an edge of the second thickness portion in a short direction of the thermal conductor.

9. The heating device according to claim 8, wherein the bent portion is parallel to the longitudinal direction of the thermal conductor.

10. The heating device according to claim 1, wherein the first span is disposed in a center span of the thermal conductor in the longitudinal direction of the thermal conductor.

11. A fixing device comprising:

a tubular rotator configured to rotate;

a heat source configured to heat the tubular rotator;

a nip former disposed opposite an inner circumferential surface of the tubular rotator;

a support configured to support the nip former; and a pressure rotator configured to press against the nip former via the tubular rotator to form a nip between the tubular rotator and the pressure rotator, the nip through which a recording medium is conveyed, the nip former including:

a base; and a thermal conductor being mounted on the base and having a thermal conductivity greater than a thermal conductivity of the support, the thermal conductor including:

a first face contacting the tubular rotator;

a second face being opposite the first face;

a first thickness portion disposed in a first span of the thermal conductor in a longitudinal direction of the thermal conductor, the first thickness portion having a first thickness; and a second thickness portion disposed in at least a part of a second span of the thermal conductor in the longitudinal direction of the thermal conductor, the second span being different from the first span, the second thickness portion having a second thickness greater than the first thickness of the first thickness portion, the second thickness portion including a folded portion disposed on the second face, wherein the support is configured to support the base, wherein the folded portion includes a folded end in the longitudinal direction of the thermal conductor, and wherein the base includes a positioner configured to contact the folded end of the folded portion.

12. The fixing device according to claim 11, wherein the nip former extends in a longitudinal direction that is parallel to an axial direction of the tubular rotator.

13. The fixing device according to claim 11, wherein a length of the folded portion in a short direction perpendicular to the longitudinal direction of the thermal conductor is substantially equivalent to a length of the nip in a short direction of the nip.

* * * * *